US008434586B2

(12) United States Patent
Pawelski et al.

(10) Patent No.: US 8,434,586 B2
(45) Date of Patent: May 7, 2013

(54) SOUND INSULATION IN A REFRIGERANT CIRCUIT

(75) Inventors: Thomas Pawelski, Braunschweig (DE); Ulrich Fochler, Braunschweig (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 13/554,162

(22) Filed: Jul. 20, 2012

(65) Prior Publication Data

US 2013/0020146 A1 Jan. 24, 2013

(30) Foreign Application Priority Data

Jul. 22, 2011 (DE) ..... 10 2011 108 372

(51) Int. Cl.
*G10K 11/00* (2006.01)

(52) U.S. Cl.
USPC ..... 181/175

(58) Field of Classification Search ..... 181/403, 181/175; 417/312
See application file for complete search history.

(56) References Cited

U.S. PATENT DOCUMENTS

| | | | | |
|---|---|---|---|---|
| 3,750,840 | A * | 8/1973 | Holme | 181/269 |
| 4,370,104 | A * | 1/1983 | Nelson et al. | 417/312 |
| 5,077,981 | A * | 1/1992 | de la Rosa | 62/193 |
| 5,584,674 | A * | 12/1996 | Mo | 417/312 |
| 6,017,197 | A * | 1/2000 | Jensen et al. | 417/312 |
| 6,129,522 | A * | 10/2000 | Seo | 417/312 |
| 6,155,800 | A * | 12/2000 | Todescat et al. | 417/312 |
| 6,358,019 | B1 * | 3/2002 | Iversen et al. | 417/312 |
| 6,425,742 | B1 * | 7/2002 | Fukuda et al. | 417/317 |
| 6,446,454 | B1 * | 9/2002 | Lee et al. | 62/296 |
| 6,547,032 | B2 * | 4/2003 | Yoon et al. | 181/229 |
| 6,715,582 | B2 * | 4/2004 | Nissen et al. | 181/231 |
| 6,763,909 | B2 * | 7/2004 | Svendsen | 181/227 |
| 7,052,247 | B2 * | 5/2006 | Lee | 417/312 |
| 7,316,291 | B2 * | 1/2008 | Thomsen et al. | 181/262 |
| 7,435,060 | B2 * | 10/2008 | Kim et al. | 417/312 |
| 8,016,071 | B1 * | 9/2011 | Martinus et al. | 181/282 |

(Continued)

FOREIGN PATENT DOCUMENTS

| | | |
|---|---|---|
| DE | 60 30 4550 T2 | 11/2006 |
| DE | 10 2006 038 726 A1 | 2/2008 |

(Continued)

*Primary Examiner* — Forrest M Phillips
(74) *Attorney, Agent, or Firm* — Pearl Cohen Zedek Latzer, LLP

(57) ABSTRACT

A muffler device for a refrigerant circuit with refrigerant containing refrigerant oil comprises a housing in which an upper muffler chamber and a lower muffler chamber are arranged, whereby the upper muffler chamber has an upper feed opening that can be connected to the refrigerant circuit, and the lower muffler chamber has a lower discharge opening that can be connected to the refrigerant circuit, and whereby a muffler partition is arranged between the upper and lower muffler chambers, said partition having at least one muffling pipe that connects the upper muffler chamber to the lower muffler chamber, and an upper section of said pipe with an upper opening projects into the upper muffler chamber, whereby, at a filling level that exceeds the height of the upper opening, refrigerant oil that has accumulated on the top of the muffler partition can be fed with refrigerant vapor to the lower muffler chamber.

12 Claims, 2 Drawing Sheets

U.S. PATENT DOCUMENTS

| | | | | |
|---|---|---|---|---|
| 2002/0134617 | A1* | 9/2002 | Nissen et al. | 181/403 |
| 2004/0005225 | A1* | 1/2004 | Marshall et al. | 417/312 |
| 2004/0103683 | A1* | 6/2004 | Yoon | 62/296 |
| 2004/0179955 | A1* | 9/2004 | Lee | 417/312 |
| 2004/0228741 | A1* | 11/2004 | Kim et al. | 417/312 |
| 2005/0002798 | A1* | 1/2005 | Bjerre et al. | 417/312 |
| 2005/0129534 | A1* | 6/2005 | Lee | 417/312 |

FOREIGN PATENT DOCUMENTS

| | | | |
|---|---|---|---|
| DE | 10 2008 050 011 | A1 | 5/2009 |
| EP | 1 431 087 | A2 | 6/2004 |
| EP | 1 811 174 | A2 | 7/2007 |
| JP | 11-62827 | A | 3/1999 |
| KR | 20090112971 | A | 10/2009 |

* cited by examiner

SOUND INSULATION IN A REFRIGERANT CIRCUIT

CROSS-REFERENCE TO RELATED APPLICATIONS

This application claims priority from German Patent Application No. DE 10 2011 108 372.7, filed Jul. 22, 2011, which is hereby incorporated by reference in its entirety.

FIELD OF THE INVENTION

The invention relates to a muffler device for a refrigerant circuit that also carries refrigerant oil.

SUMMARY OF THE INVENTION

It is a known procedure to employ mufflers in a refrigerant circuit by means of which the pressure pulses of a refrigerant as it exits a compressor of the refrigerant circuit can be reduced. Thus, for instance, German laid-open document DE 10 2008 050 011 A1 describes a muffler which is referred to as a "straight type" muffler in which the inlet pipe through which the refrigerant flows into the muffler chamber is aligned with respect to the outlet pipe through which the refrigerant exits the muffler chamber. Here, the refrigerant flows linearly into the muffler chamber. Moreover, the cited document describes a "manifold type" muffler by means of which the direction in which the inlet pipe is joined to the housing of the muffler chamber runs orthogonally to the direction in which the outlet pipe is joined to the housing. Moreover, South Korean examined patent application KR 10 2008 0038784 A discloses a muffler for the air-conditioning system of a vehicle in which an inlet pipe for a refrigerant and an outlet pipe for a refrigerant are arranged on two opposite sides of the muffler housing and are aligned in different directions inside the housing.

A refrigerant oil is normally employed for purposes of lubricating the moving parts in the refrigeration system circuit, especially of a compressor. Such a refrigerant oil becomes mixed with the refrigerant of the refrigeration system circuit during operation, as a consequence of which it also circulates in the refrigerant circuit. Polyalkylene glycol is a suitable refrigerant oil for the refrigerant R 134 A.

The refrigerant oil is normally entrained by the flow of refrigerant in the pipes of the refrigerant line. However, the prior-art mufflers entail the risk that the refrigerant oil might precipitate on an inner wall of the muffler chamber, as a result of which the muffler then works as an oil trap.

As described in European patent application EP 1 811 174 A2, in order to prevent oil precipitation in the muffler, an oil-precipitation chamber can be installed upstream from the muffler, so that the refrigerant oil is returned from said oil-precipitation chamber to the compressor. DE 60 30 4550 T2, which is the translation of an European patent, also discloses the approach of carrying out an oil-precipitation procedure before the refrigerant enters the muffler chamber.

SUMMARY OF THE INVENTION

The present invention is based on the objective of achieving sound insulation in a refrigerant circuit that also conveys refrigerant oil, whereby the accumulation of refrigerant oil in the muffler chamber can be reduced or prevented.

This objective is achieved by means of the features of the independent claim.

The inventive muffler device for a refrigerant circuit that also carries refrigerant oil comprises a housing in which an upper muffler chamber and a lower muffler chamber are arranged, whereby the upper muffler chamber has an upper feed opening that can be connected to the refrigerant circuit as well as a lower discharge opening that can be connected to the refrigerant circuit, and a muffler partition is arranged between the upper and lower muffler chambers, said partition having a muffling pipe that connects the upper muffler chamber to the lower muffler chamber, and an upper section of said pipe with an upper opening projects into the upper muffler chamber, whereby, at a filling level that exceeds the height of the upper pipe section, the refrigerant oil that has accumulated on the top of the muffler partition can be fed together with refrigerant vapor to the lower muffler chamber.

The volumes and dimensions of the upper muffler chamber, of the lower muffler chamber and of the muffling pipe are designed for interference muffling of the pressure pulses in the gaseous refrigerant. Preferably, the lengthwise extension of the upper muffler chamber in the vertical direction is the same as the lengthwise extension in the horizontal direction. In particular, the length of the upper pipe section is adapted to the dimensions of the interior of the upper muffler chamber so as to achieve optimal sound insulation. Moreover, in order to optimize the sound insulation, the position of the upper opening is arranged offset with respect to the position of the muffling pipe, whereby the inflow direction of the refrigerant into the interior of the muffler chamber is oriented parallel to the outflow direction through the muffling pipe. The position of the lower opening is selected in such a way that the outflow direction of the refrigerant is oriented orthogonally to the inflow direction of the refrigerant through the muffling pipe into the interior of the lower muffler chamber. It goes without saying that the invention also encompasses any different relative orientation of the flow through the upper or lower openings in order to orient the flow through the muffling pipe.

During operation, refrigerant that has entrained refrigerant oil is fed into the upper muffler chamber via the upper feed opening, and it then comes into contact with the inner walls of the upper muffler chamber. In this process, oil accumulates on the top of the muffler partition. The amount of accumulated refrigerant oil depends here on the height of the upper opening which, however, cannot be reduced at will so as not to detrimentally affect the muffling properties of the device. After a certain period of operation of the device, however, the amount of accumulated oil will have increased to such an extent that the filling level will have reached the height of the upper opening. From that point in time on, the refrigerant gas that passes through the muffling pipe can transport into the lower muffler chamber some of the accumulated oil in the form of oil droplets. Since the pulses of the refrigerant have already been muffled in the upper muffler chamber, only a small amount of refrigerant and entrained refrigerant oil comes into contact with the inner walls of the lower muffler chamber, so that less oil precipitates here. In contrast to the mufflers known from the state of the art, a great deal of oil is returned to the compressor via the lower discharge opening. However, the volume of the upper muffler chamber is reduced by the amount of oil accumulated during operation, which alters the muffling properties of the upper muffler chamber in comparison to its muffling properties without the presence of accumulated refrigerant oil.

The invention is also achieved by a muffler device for a refrigerant circuit having a refrigerant that contains a refrigerant oil, comprising a housing in which a first muffler chamber and a second muffler chamber are arranged, whereby the first muffler chamber has a first feed opening that can be connected to the refrigerant circuit and the second muffler chamber has a second discharge opening that can be connected to the refrigerant circuit, and a muffler partition is arranged between the first and second muffler chambers, said partition having a muffling pipe that connects the first muffler chamber to the second muffler chamber, and a first section of said pipe with a first opening projects into the first muffler chamber, whereby at least one oil-bypass opening is arranged in the muffler partition and it connects the first and second muffler chambers.

In particular, the objective is achieved by a muffler device that comprises a housing in which an upper muffler chamber and a lower muffler chamber are arranged, whereby the upper muffler chamber has an upper feed opening that can be connected to the refrigerant circuit as well as a lower discharge opening that can be connected to the refrigerant circuit, and whereby a muffler partition is arranged between the upper and lower muffler chambers, said partition having a muffling pipe that connects the upper muffler chamber to the lower muffler chamber, and an upper section of said pipe with an upper opening projects into the upper muffler chamber, whereby at least one oil-bypass opening is arranged in the muffler partition and it connects the upper and lower muffler chambers.

The objective is also achieved by a muffler device comprising a housing in which a left-hand muffler chamber and a right-hand muffler chamber are arranged, whereby the left-hand muffler chamber has a left-hand feed opening that can be connected to the refrigerant circuit as well as a right-hand discharge opening that can be connected to the refrigerant circuit, and a muffler partition is arranged between the left-hand and right-hand muffler chambers, said partition having a muffling pipe that connects the left-hand muffler chamber to the right-hand muffler chamber, and a left-hand section of said pipe with a left-hand opening projects into the left-hand muffler chamber, whereby at least one oil-bypass opening is arranged in the muffler partition in an area beneath the height of the left-hand opening, and it connects the left-hand and right-hand muffler chambers. In this embodiment, the oil can accumulate in the area of the lower housing wall, whereby, however, since the oil-bypass opening is situated relatively low, it is ensured that this oil is present both in the left-hand and in the right-hand muffler chambers so that it can be discharged along with the refrigerant through the right-hand discharge opening. It goes without saying that here, the terms "left-hand" and "right-hand" serve merely to define a direction. For this reason, the invention also encompasses a variant in which the refrigerant is fed into a right-hand muffler chamber and the refrigerant is discharged out of a left-hand muffler chamber.

In the last two described embodiments of the invention, a return of the oil to the compressor is ensured even when the filling level of the accumulated oil has not yet reached the height of the upper or left-hand opening. In particular, it is also achieved that the volume of the upper muffler chamber is only reduced to a small extent by oil that has accumulated during operation.

In an advantageous manner, it is provided that the muffling pipe has a clear diameter D and that the at least one oil-bypass opening has a clear diameter $d<D$, especially a diameter $d<\frac{1}{2}D$. When the oil bypass has a clear diameter $d<D$, it is thus achieved that the muffling properties of the chamber are largely determined by the chamber volume and by the muffling pipe, and only to a lesser extent by the oil-bypass opening.

For the acoustic optimization of the device, it is advantageously provided that a lower section of the muffling pipe has a lower opening that projects into the lower muffler chamber. In particular, the upper and lower pipe sections are of the same length.

Analogously, it is provided that a right-hand section of the insulating pipe with a right-hand opening projects into the right-hand muffler chamber.

Another embodiment of the invention is characterized in that at least two oil-bypass openings are provided in order to allow a faster release of oil into the lower muffler chamber.

Another embodiment of the invention is characterized in that, as seen from the interior of the upper muffler chamber, the muffler partition has a concave shape, as a result of which the release of oil into the lower muffler chamber is further accelerated.

Another embodiment of the invention is characterized in that the housing is configured in the form of a deep-drawn pot made of sheet metal, as a result of which the housing can be easily manufactured in terms of production engineering.

Another embodiment of the invention is characterized in that the housing has a circular cross section in a plane perpendicular to the longitudinal axis of the housing, as a result of which a housing having mechanically stable pipes can be easily manufactured in terms of production engineering, and its acoustic muffling properties can be calculated very easily.

Another embodiment of the invention is characterized in that the housing has an ellipsoid cross section in a plane perpendicular to the longitudinal axis of the housing, as a result of which a housing having mechanically stable pipes can be easily manufactured in terms of production engineering, and its acoustic muffling properties can be calculated very easily.

Additional advantages, features and details ensue from the description below in which at least one embodiment is described in depth, making reference to the drawing. Described and/or depicted features on their own or in any feasible combination constitute the invention, optionally also independently of the patent claims, and they especially can also be the subject matter of one or more separate inventions. Identical or similar parts can be provided with the same reference numerals.

BRIEF DESCRIPTION OF THE DRAWINGS

The following is shown in schematic form.

DETAILED DESCRIPTION OF THE INVENTION

Figure 1C:
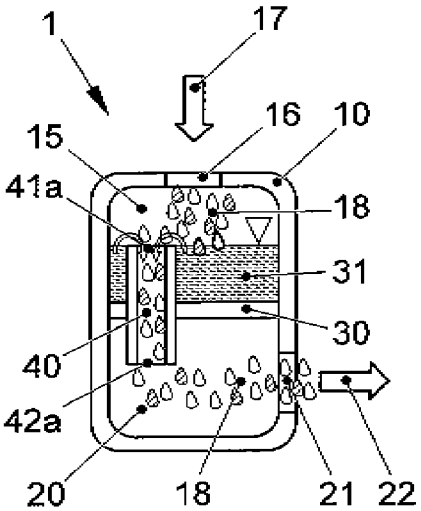
FIG. 1: a muffler device, with an upper muffler chamber and a lower muffler chamber.
Figure 1B:
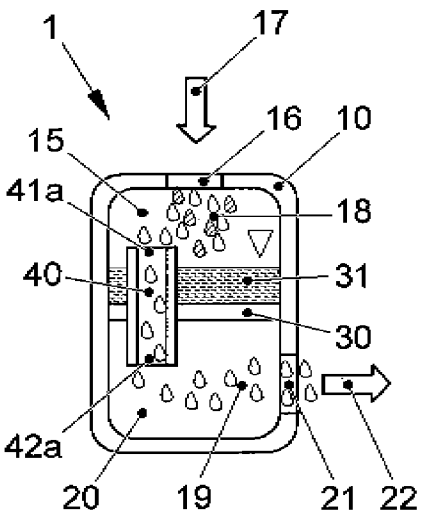
Figure 1A:
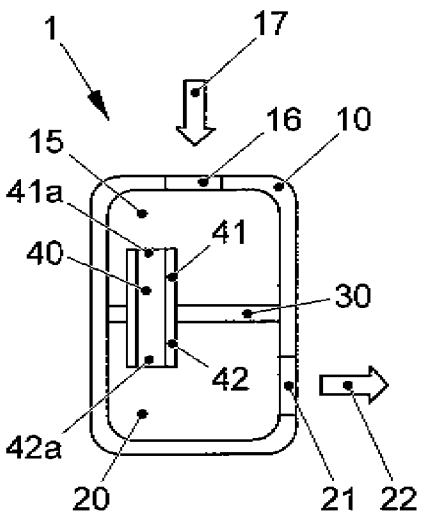

FIGS. 1*a* to 1*c* show a schematic depiction of a muffler device 1 according to the invention, comprising a housing 10 in which an upper muffler chamber 15 and a lower muffler chamber 20 are arranged. The muffler device 1 is incorporated into a refrigerant circuit, particularly of a motor vehicle, and it especially allows the muffling of pressure pulses in the refrigerant. The upper muffler chamber 15 has an upper feed opening 16 for the feed 17 of refrigerant. A partition 30 is arranged between the upper muffler chamber 15 and the lower muffler chamber 20, said partition having an insulating pipe 40 connecting the upper muffler chamber 15 and the lower muffler chamber 20. The volumes and dimensions of the upper muffler chamber 15, of the lower muffler chamber 20 and of the muffling pipe 40 are designed for interference muffling of the pressure pulses in the gaseous refrigerant. Moreover, in order to optimize sound insulation, the position of the upper opening 16 is arranged offset with respect to the position of the muffling pipe 40. The lower muffler chamber 20 has a discharge opening 21 that discharges 22 refrigerant and that has an orthogonal orientation with respect to the muffling pipe 40 as well as to the orientation of the upper opening 16. The muffling pipe 40 has an upper part 41 that projects into the interior of the muffler chamber 15. The length of the upper section 41 is specified as a function of the desired muffling properties of the muffler chamber 15. The muffling pipe 40 has a lower section 42 that projects into the lower muffler chamber 20. The length of a lower section 42 of the muffling pipe 40 is specified as a function of the desired muffling properties of the lower muffler chamber 20. The muffling pipe 40 has a clear diameter D that is likewise specified as a function of the desired muffling properties of the upper muffler chamber 15 as well as of the lower muffler chamber 20.

FIG. 1*b* shows a scenario in which there is already an oil accumulation 31 on the top of the partition 30 due to oil that has precipitated out of the mixture 18 consisting of refrigerant gas and oil droplets. Here it is indicated that, owing to the precipitation of the oil, the refrigerant gas 19 that is carried to the refrigerant circuit through the discharge opening 21 is relatively free of refrigerant oil.

FIG. 1*c* shows that, as soon as the oil accumulation 31 has reached a filling level that matches the height of the upper opening 41*a*, refrigerant oil along with refrigerant gas can be conveyed into the lower muffler chamber 20 and optionally returned to the compressor of the refrigerant circuit via the return 22.

Figure 2A:
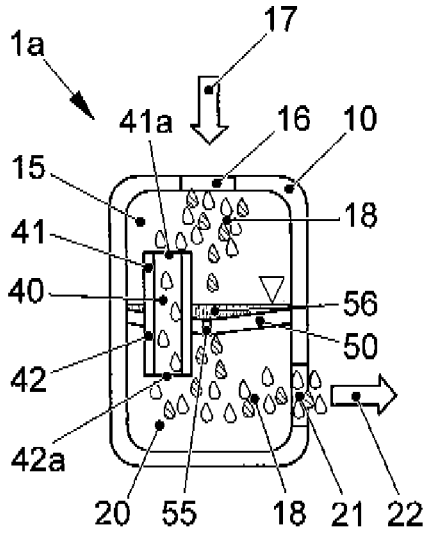
FIG. 2: muffler devices with an improved oil bypass.

FIG. 2*a* shows another embodiment of a muffler device. In the case of the muffler arrangement 1*a*, the partition 30 has an oil-bypass opening 55 through which the refrigerant oil stemming from a refrigerant-oil accumulation 56 can reach the lower muffler chamber 20 and mix with the refrigerant gas so as to form a mixture 18 consisting of refrigerant gas and oil droplets. As long as sufficient refrigerant oil flows out through the oil-bypass opening 55, the refrigerant-oil accumulation 56 has a smaller volume than the refrigerant-oil accumulation 31 according to FIG. 1*c*. The outflow of oil from the refrigerant-oil accumulation 56 can be accelerated in that the partition 50 in the area of the bypass opening 55 is lowered or has a concave shape as seen from the interior of the upper muffler chamber 15 since in this case, refrigerant oil can flow from the areas of the partition 50 that are further away from the oil-bypass opening 55 into the area of the oil-bypass opening 55. It is preferable for the muffling pipe 40 to have a clear diameter D and for the oil-bypass opening 55 to have a clear diameter d<D, especially a diameter d<½D.

Figure 2B:
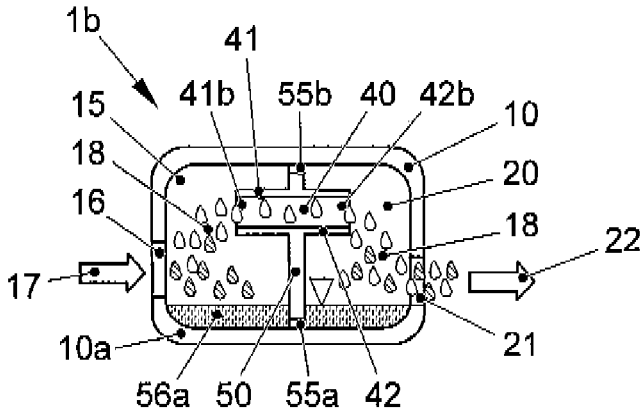

FIG. 2*b* shows another embodiment of a muffler device 1*b* comprising a housing in which a left-hand muffler chamber 15 and a right-hand muffler chamber 20 are arranged. The muffler device 1*b* is oriented so as to be rotated by an angle of 90° relative to the device 1*a*. The left-hand muffler chamber 15 has a left-hand feed opening 16 that can be connected to the refrigerant circuit, whereby the right-hand muffler chamber 20 has a right-hand discharge opening 21 that can be connected to the refrigerant circuit. A muffler partition 50 is arranged between the left-hand and right-hand muffler chambers 15 and 20, said partition having a muffling pipe 40 that connects the left-hand muffler chamber 15 to the right-hand muffler chamber 20, and a left-hand section 41 of said pipe with a left-hand opening 41 projects into the left-hand muffler chamber 15. A right-hand section 42 of said pipe 40 projects into the right-hand muffler chamber 20. A lower oil-bypass opening 55*a* and an upper oil-bypass opening 55*b* are arranged in the muffler partition 50, said openings 55*a* and 55*b* connecting the left-hand and right-hand muffler chambers 15 and 20. Accumulated oil 56*a* is shown in the area of the lower housing wall, said oil accumulation extending to the left as well as to the right of the muffler partition 50. Oil can be returned to the compressor already in the case of very small amounts of accumulated oil since the oil can flow relatively unimpeded from the left-hand muffler chamber 15 through the lower opening 55*a* into the right-hand muffler chamber 20.

List of Reference Numerals

1 muffler arrangement
1*a*, 1*b* muffler arrangement
10 housing
10*a* lower housing wall
15 upper muffler chamber
16 upper feed opening
17 inflow
18 mixture of refrigerant gas and oil droplets
19 refrigerant
20 lower muffler chamber
21 discharge opening
22 return flow
30 muffler partition
31 oil accumulation
40 muffling pipe
41 upper section of the muffling pipe
41*a* upper opening
41*b* left-hand opening
42 lower section of the muffling pipe
42*a* lower opening
42*b* right-hand opening
50 muffler partition
55, 55*a*, 55*b* oil-bypass opening
56, 56*a* oil accumulation

The invention claimed is:

1. A muffler device for a refrigerant circuit with refrigerant containing refrigerant oil, comprising: a housing in which an upper muffler chamber and a lower muffler chamber are arranged, whereby the upper muffler chamber has an upper feed opening that can be connected to the refrigerant circuit, and the lower muffler chamber has a lower discharge opening that can be connected to the refrigerant circuit, and a muffler partition is arranged between the upper and lower muffler chambers, said partition having at least one muffling pipe that connects the upper muffler chamber to the lower muffler chamber, and an upper section of said pipe with an upper opening projects into the upper muffler chamber, whereby, at a filling level that exceeds the height of the upper opening, refrigerant oil that has accumulated on the top of the muffler partition can be fed together with refrigerant vapor to the lower muffler chamber, whereby at least one oil-bypass opening is arranged in the muffler partition and it connects the first and second muffler chambers.

2. The muffler device for a refrigerant circuit with refrigerant containing refrigerant oil, comprising:

a housing in which a first muffler chamber and a second muffler chamber are arranged, whereby the first muffler chamber has a first feed opening that can be connected to the refrigerant circuit and the second muffler chamber has a second discharge opening that can be connected to the refrigerant circuit, and a muffler partition is arranged between the first and second muffler chambers, said partition having at least one muffling pipe that connects the first muffler chamber to the second muffler chamber, and a first section of said pipe with a first opening projects into the first muffler chamber, whereby at least one oil-bypass opening is arranged in the muffler partition and it connects the first and second muffler chambers, wherein the first muffler chamber is an upper muffler chamber and the second muffler chamber is a lower second muffler chamber, whereby the first feed opening is configured as an upper feed opening that can be connected to the refrigerant circuit, and the second discharge opening is configured as a lower discharge opening that can be connected to the refrigerant circuit, and the muffler partition has at least one muffling pipe that connects the upper muffler chamber to the lower muffler chamber, and an upper section of said pipe with an upper opening projects into the upper muffler chamber, whereby at least one oil-bypass opening is arranged in the muffler partition and it connects the first and second muffler chambers.

3. The muffler device according to claim 1, wherein at least two oil-bypass openings are provided in the muffler partition.

4. The muffler device according to claim 1, wherein the muffling pipe has a clear diameter D and at least one oil-bypass opening has a clear diameter $d<D$, especially a diameter $d<\frac{1}{2}D$.

5. The muffler device according to claim 1, wherein the housing is configured in the form of a deep-drawn pot made of sheet metal.

6. The muffler device according to claim 1, wherein the housing has a circular cross section in a plane perpendicular to the longitudinal axis of the housing.

7. The muffler device according to claim 1, wherein the housing has an ellipsoid cross section in a plane perpendicular to the longitudinal axis of the housing.

8. The muffler device according to claim 2, wherein at least two oil-bypass openings are provided in the muffler partition.

9. The muffler device according to claim 2, wherein the muffling pipe has a clear diameter D and at least one oil-bypass opening has a clear diameter $d<D$, especially a diameter $d<\frac{1}{2}D$.

10. The muffler device according to claim 2, wherein the housing is configured in the form of a deep-drawn pot made of sheet metal.

11. The muffler device according to claim 2, wherein the housing has a circular cross section in a plane perpendicular to the longitudinal axis of the housing.

12. The muffler device according to claim 2, wherein the housing has an ellipsoid cross section in a plane perpendicular to the longitudinal axis of the housing.

* * * * *